US007806775B1

(12) United States Patent
Kain

(10) Patent No.: US 7,806,775 B1
(45) Date of Patent: Oct. 5, 2010

(54) SWING SET AND CLIMBING APPARATUS WITH DISPLACEABLE SWING

(76) Inventor: Don Kain, 174 Hillcrest Ct., Lake Arrowhead, CA (US) 92352

( * ) Notice: Subject to any disclaimer, the term of this patent is extended or adjusted under 35 U.S.C. 154(b) by 125 days.

(21) Appl. No.: 11/966,686

(22) Filed: Dec. 28, 2007

(51) Int. Cl.
*A63G 9/06* (2006.01)
*A63G 9/12* (2006.01)

(52) U.S. Cl. ..... 472/118

(58) Field of Classification Search ..... 472/118–125; 482/24, 35–37
See application file for complete search history.

(56) References Cited

U.S. PATENT DOCUMENTS

| | | | | | |
|---|---|---|---|---|---|
| 1,340,904 | A | | 5/1920 | Medart | |
| 2,222,119 | A | * | 11/1940 | Overholt | 482/35 |
| D146,557 | S | | 4/1947 | Cosme | |
| D160,320 | S | | 10/1950 | Horowitz | |
| 2,720,430 | A | * | 10/1955 | Meng et al. | 52/645 |
| 3,032,344 | A | * | 5/1962 | Hjelte | 482/37 |
| 3,090,273 | A | | 5/1963 | Fox | |
| 3,714,672 | A | | 2/1973 | Condon | |
| 3,971,561 | A | * | 7/1976 | Wenzel | 482/36 |
| 4,278,250 | A | * | 7/1981 | Baynes et al. | 482/36 |
| 5,147,247 | A | | 9/1992 | Addleman | |
| 5,449,323 | A | | 9/1995 | Melton | |
| 5,624,321 | A | | 4/1997 | Snyder | |
| 5,630,236 | A | | 5/1997 | Messin | |
| 6,702,686 | B1 | | 3/2004 | Brown | |
| 6,994,630 | B2 | * | 2/2006 | Paesang | 472/118 |
| 7,014,594 | B2 | * | 3/2006 | Stoltz | 482/24 |
| 2004/0087382 | A1 | | 5/2004 | Goldstein | |

FOREIGN PATENT DOCUMENTS

| | | |
|---|---|---|
| GB | 2053702 | 2/1981 |

* cited by examiner

*Primary Examiner*—Kien T Nguyen
(74) *Attorney, Agent, or Firm*—Knobbe, Martens, Olson & Bear, LLP

(57) ABSTRACT

A mechanism for spacing a swing from underneath a horizontal climbing ladder of a jungle gym-type swing apparatus. In one implementation, the apparatus is spring biased such that the swing is laterally spaced away from the plane of the horizontal climbing ladder when not in use and, in another implementation, the apparatus fixedly positions the swing away from the plane of the horizontal climbing ladder when not in use.

13 Claims, 6 Drawing Sheets

SWING SET AND CLIMBING APPARATUS WITH DISPLACEABLE SWING

BACKGROUND OF THE INVENTION

1. Field of the Invention

The present invention relates to a swing set and climbing apparatus and, in particular, relates to a swing set and climbing apparatus where the swing can be displaced away from the vertical plane of the climbing apparatus.

2. Description of the Related Art

Swing sets and jungle gyms are very common backyard play apparatuses for children. Presently, many swing sets also incorporate a horizontal climbing ladder or jungle gym to allow the users to hang downward and travel from one end of the horizontal climbing ladder or jungle gym using their arms. Typically, the horizontal climbing ladder has two horizontal support members that are interconnected by a plurality of rungs that are spaced apart a preselected distance so as to allow the users to horizontally travel down the ladder by reaching for and grasping successive rungs.

In many circumstances, play apparatuses that incorporated horizontal climbing ladders or other horizontal climbing structures will also have hanging play devices, such as swings, trapeze bars and bouncers, that are often attached to one of the climbing ladder's horizontal support members. Particularly in wood construction swing sets, it is very common to have the swings extend vertically downward from one of the horizontal support members of the climbing structure. Having the swings hang down from the horizontal support member has the advantage of not requiring a separate support member to mount the swings thereby resulting in a less expensive and more compact play apparatus.

One difficulty associated with play apparatuses that have a hanging play device which hangs downward from a horizontal support member of a climbing structure is that if a person falls off the climbing structure, the device can be in the plane of the person's fall. This can result in the person becoming entangled with the device while they fall. When users become tangled with the device, their risk of injury increases as the device may disrupt the normal fall of the user. For example, a person falling off a ladder can get their foot caught in the swing which will result in the user being pitched head-down into the ground. This problem has become severe enough that various consumer product safety agencies are contemplating banning the sale of swing sets or other play apparatus that have the swings or other hanging play devices extending downward from the horizontal support of a climbing ladder or similar climbing structure.

Unfortunately, adding a separate spaced apart support member for the swing or device increases the cost and size of swing sets as additional horizontal and vertical support members must generally be included. This is a particular problem for pre-assembled swing set kits sold by retailers who also incur increased shipping costs.

Hence, from the foregoing, it will be apparent that there is a need for a swing set and play apparatus where the swing or other hanging play device is far enough away from the horizontal climbing device such that a person is less likely to become entangled in the swing if the person should fall. To this end, there is a need for a swing set and play apparatus, where the swing or device will not entangle with the user should the user fall off the horizontal climbing ladder, that does not require the use of additional horizontal supports which would thereby increase the cost of the swing set and play apparatus.

SUMMARY OF THE INVENTION

The aforementioned needs are satisfied by the play apparatus of the present invention which, in one embodiment, comprises a first and second vertical support structures that are spaced apart and a generally horizontal climbing structure that is interposed between the first and second vertical support members. The apparatus further comprises a hanging play assembly that is connected to the horizontal climbing structure. The apparatus further includes a biasing mechanism that is coupled to the hanging play assembly such that the assembly is biased away from the horizontal climbing structure such that the likelihood of a person falling off of the horizontal climbing ladder and getting entangled with the assembly is reduced.

In one specific implementation, the biasing apparatus that biases a swing away from the horizontal ladder is a spring-loaded biasing system that is biased such that the swing is held away from the horizontal ladder when the swing is not in use. In this specific embodiment, the biasing system is configured such that when a person sits on the swing, the biasing is disengaged and the swing hangs generally vertically downward from the horizontal climbing structure thereby allowing the person to swing at a pivot point on the horizontal ladder. In this particular embodiment, when the person stops using the swing, the biasing mechanism urges the swing away from the horizontal ladder so as to reduce the risk of entanglement.

In another implementation, the mechanism which biases the swing away from the horizontal ladder comprises a fixed biasing member that extends horizontally and laterally outward from the horizontal climbing structure, such that the swing is permanently removed from the proximity of the horizontal ladder. In this particular embodiment, the fixed biasing member is configured so that the biasing member maintains the swing in an orientation located away from the horizontal ladder even when the person is swinging, such that the person is swinging about a pivot point that is located lateral to the horizontal ladder. It will be appreciated that because the swing is maintained at a position that is laterally distanced from the horizontal climbing structure, the risk of a person using the horizontal climbing structure and becoming entangled with the swing upon falling off the horizontal structure is reduced. This advantage is achieved without requiring additional horizontal supports to be added to the swing set thereby reducing the size and cost of the swing set. These and other objects and advantages of the present invention will become more apparent from the following description taken in conjunction with the accompanying drawings.

DETAILED DESCRIPTION OF THE ILLUSTRATED EMBODIMENT

Figure 1:
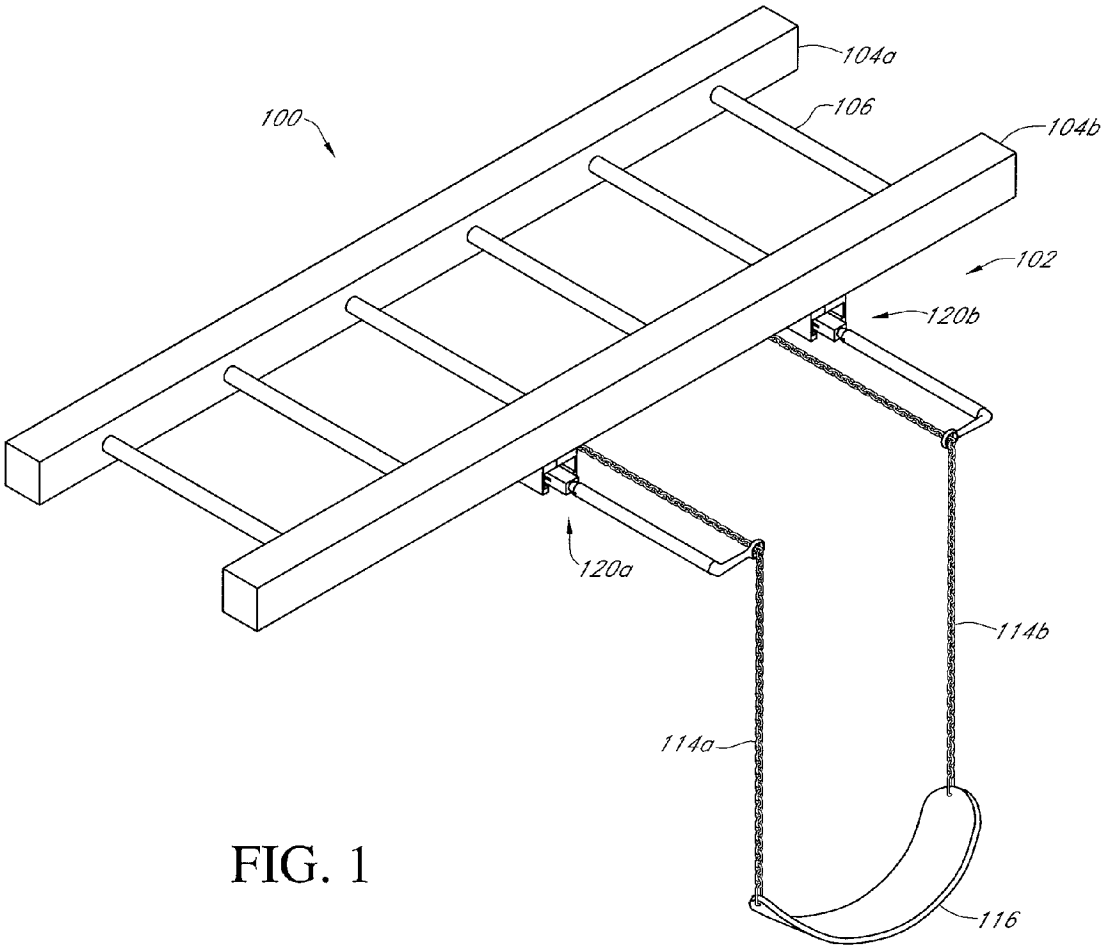
FIG. 1 is a partial perspective view of one embodiment of a swing set apparatus having a mechanism for removing the swing from an area adjacent a horizontal ladder.
Figure 2:
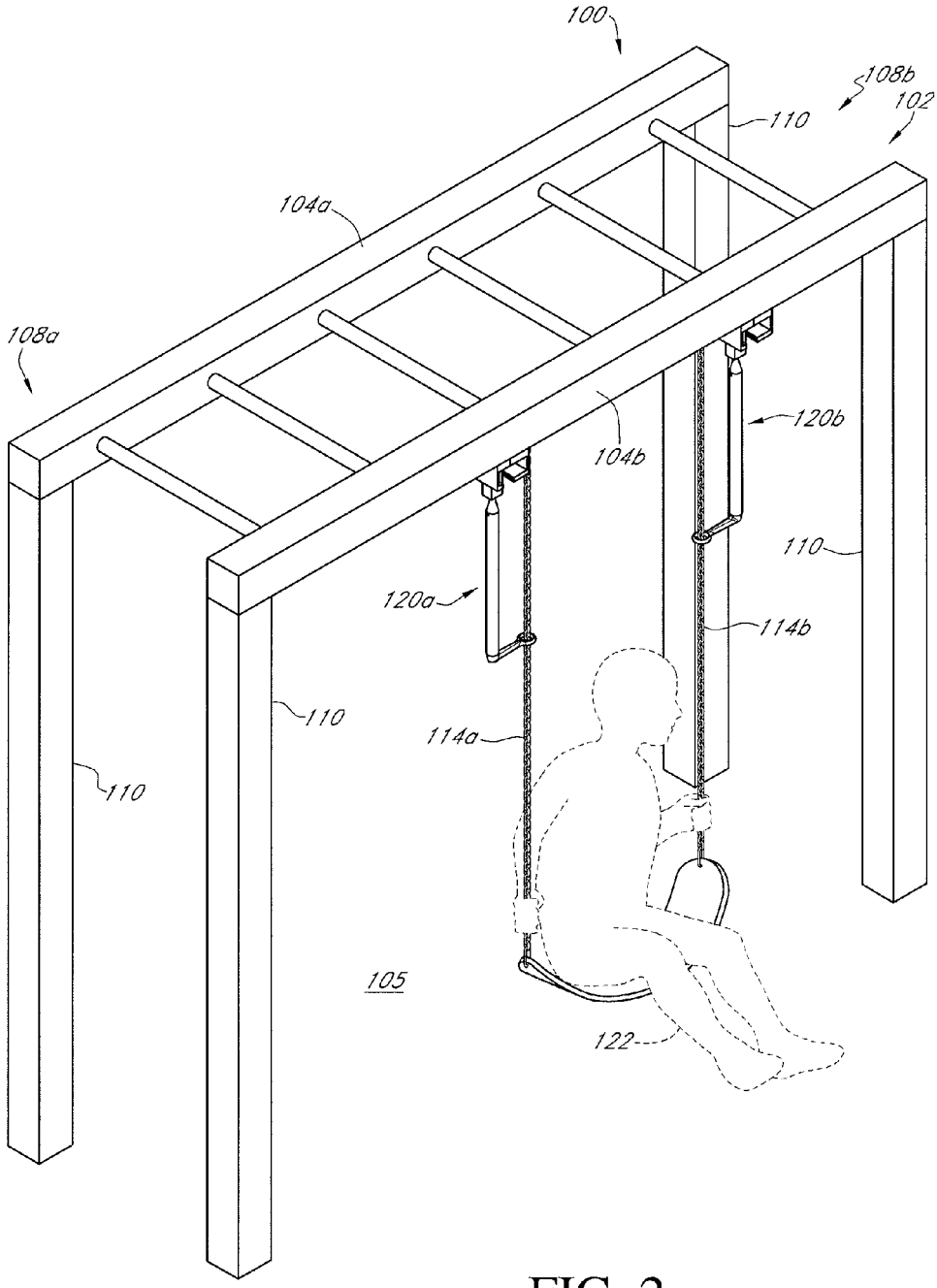
FIG. 2 is a more complete perspective view of the swing set apparatus of FIG. 1.

Reference will now be made to the drawings wherein like numerals refer to like parts throughout. As is illustrated in FIGS. 1 and 2, the swing set assembly 100 includes a horizontal climbing structure, such as a ladder, 102. While the preferred embodiments illustrated herein disclose a horizontal climbing structure that is a ladder which is generally horizontal, it will be appreciated that horizontal climbing structures can, within the meaning of this application, include structures other than ladders and structures that are not perfectly horizontal, e.g., they may be inclined, etc. The horizontal ladder 102 incorporates a pair of spaced support members 104*a*, 104*b* with a plurality of struts 106 extending between the horizontal support members 104*a*, 104*b*. The support members 104*a*, 104*b* are preferably sized and the struts 106 are preferably spaced along the length of the horizontal support members 104*a*, 104*b* so as to define a jungle gym apparatus that will allow a user to swing by their arms from strut 106 to strut 106 along the full length of the support members 104*a*, 104*b*. It will be appreciated that the exact length of the horizontal ladder 102 and the sizing and spacing of the struts 106 can, of course, vary depending upon the application without departing from the spirit of the present invention.

As is also shown in FIG. 2, vertical supports 110 are also attached to the ends 108*a*, 108*b* of the horizontal support members 104*a*, 104*b* so as to elevate the horizontal ladder 102 above the ground. In one particular implementation, the vertical supports 110 and the horizontal support members 104 are comprised of wood members, such as 4×4 members, that have been treated in a manner known in the art. It will, however, be appreciated that any of a number of different structural members can be used in conjunction with the assembly 100 without departing from the spirit of the present invention.

As is also shown in FIGS. 1 and 2, the assembly 100 also incorporates a swing 112. While the preferred embodiment shows a swing, it will be appreciated that any of a number of different hanging play devices, such as swings, bouncers, trapeze bars, and the like, can be used without departing from the spirit of the present invention. As is illustrated, the swing 112 includes a pair of flexible members, such as chains 114*a*, 114*b*, that are connected to one of the horizontal support members 104*b* of the horizontal ladder and a seat 116 that extends between the chains 114*a*, 114*b*. While the flexible members are illustrated to be chains 114*a*, 114*b*, it will be appreciated that any of a number of different flexible members can be used without departing from the spirit of the present invention. Similarly, the seat 116, in this particular implementation, is comprised of a member, such as canvas, plastic or rubber member, that extends between the two chains 114*a*, 114*b*. It will, however, be appreciated that any of a number of different well-known seats can be used without departing from the spirit of the present invention.

As is also illustrated in FIGS. 1 and 2, the swing assembly 112 also incorporates a biasing mechanism 120 that biases the swing 112 laterally outward from the horizontal support member 104*b* in the manner shown in FIG. 1. As will be discussed in greater detail below, there are several different configurations of biasing mechanism 120 that can be implemented without departing from the spirit of the present invention. The biasing mechanisms 120 are designed such that both the chains 114*a*, 114*b* and the seat 116 are laterally moved outward from the plane of the horizontal ladder assembly 102, such that, if a person should fall off the horizontal ladder assembly, the chains 114*a*, 144*b* and seat 116 are spaced away from the horizontal ladder assembly 102 so that the likelihood the person will become entangled during their fall with either the chains 114*a*, 114*b* or the seat 116 is reduced.

Figure 3A:
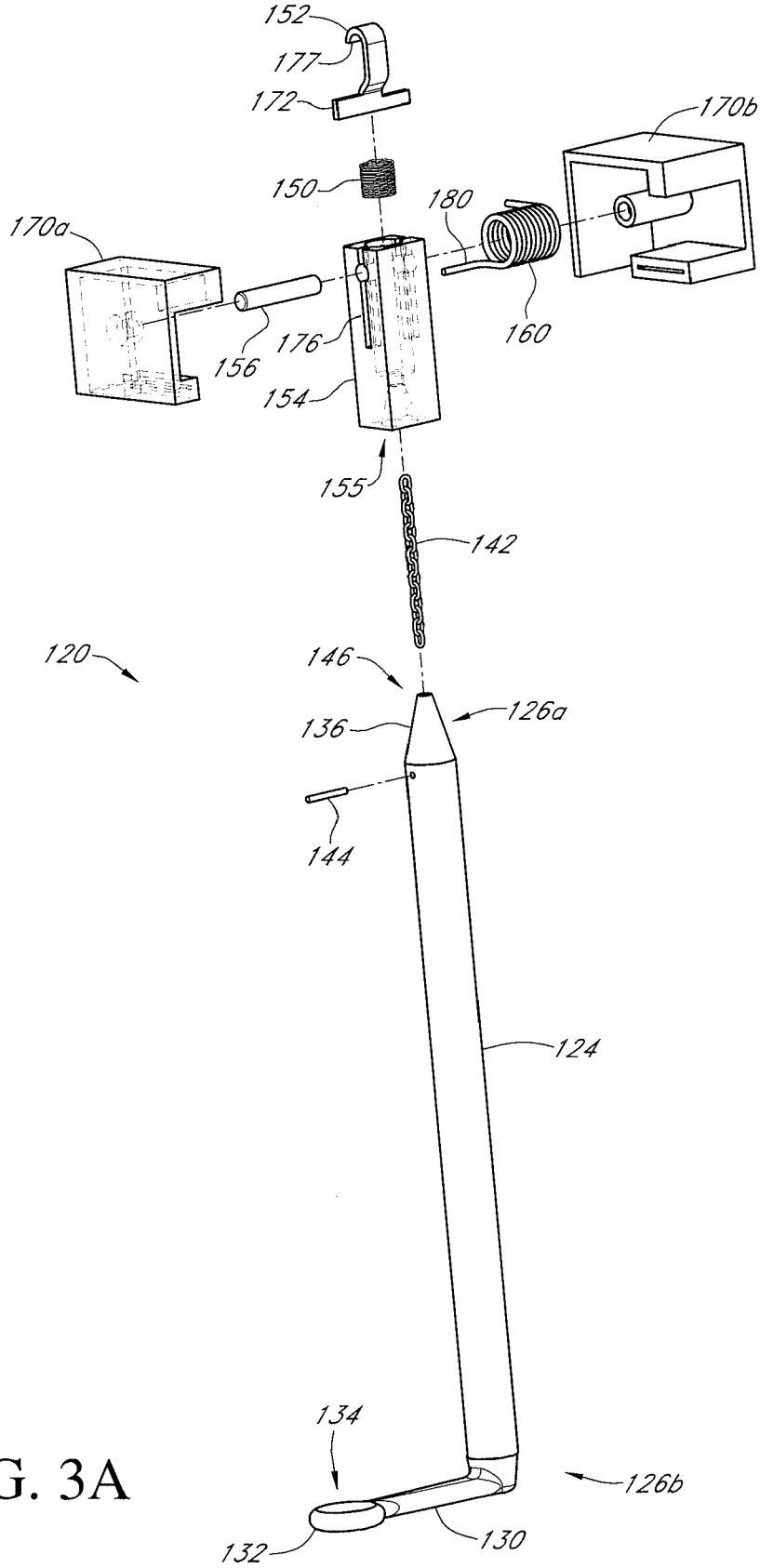
FIGS. 3A-3C are exploded views of a first biasing mechanism that is used in conjunction with the swing set assembly of FIGS. 1 and 2.
Figure 3B:
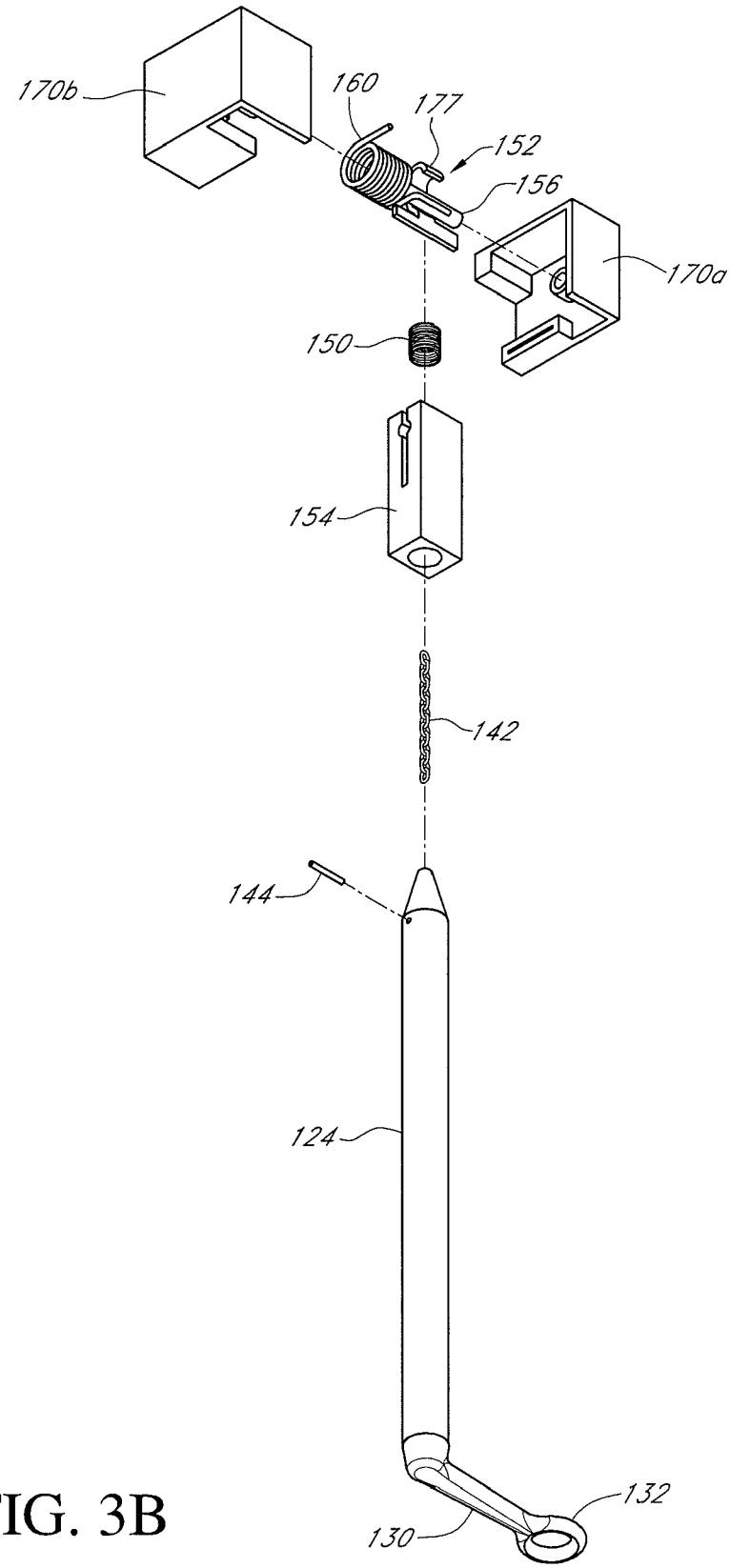
Figure 3C:
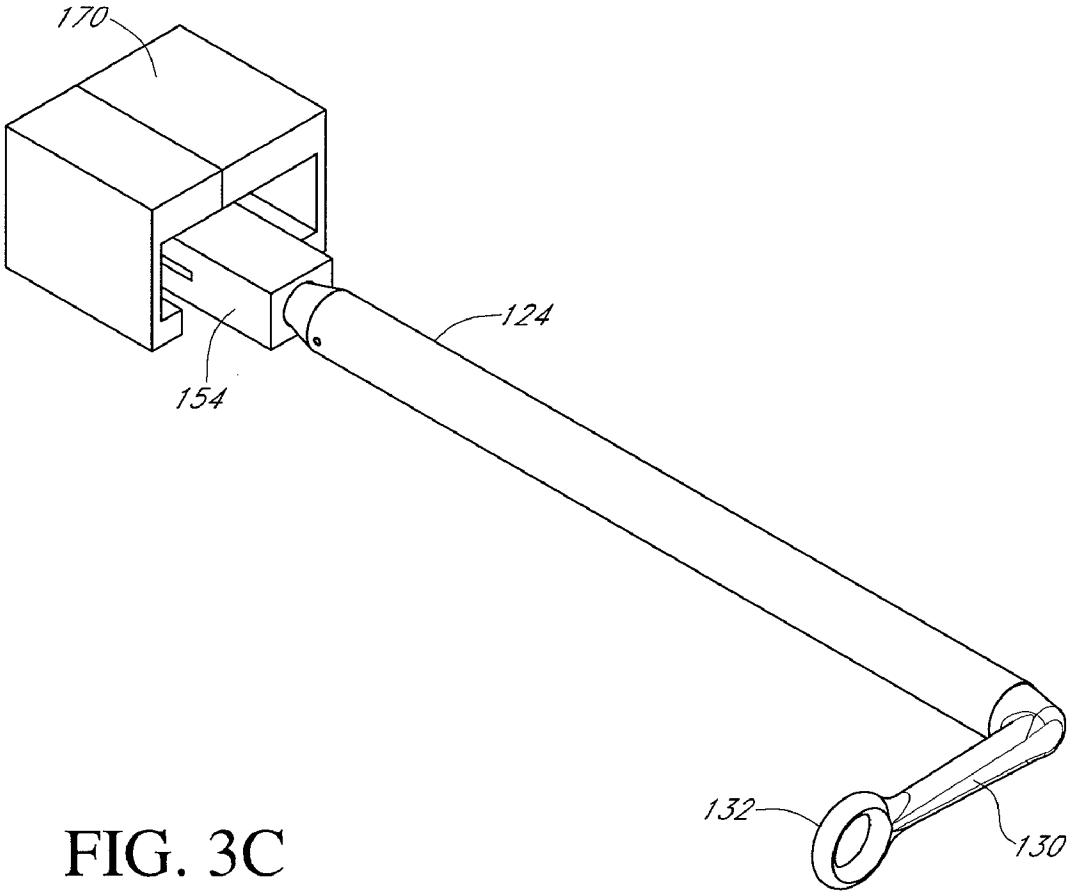

In the implementations shown in FIGS. 1 and 2 and as further illustrated in FIGS. 3A-3C, the biasing mechanism 120 is biased such that the chains of the swing 114*a*, 114*b* and the seat 116 are biased laterally outward from the horizontal support 104*b* when the swing is not in use in the manner shown in FIG. 1. However, when a person 122 (shown in phantom in FIG. 2) sits on the seat 116 of the swing 112, the biasing mechanism 120 illustrated in FIGS. 1, 2 and 3 is disengaged such that the chains 114*a*, 114*b* hang generally vertically downward from the support 104*b* such that the chains pivot about the mounting points on the support 104*b* as the person swings on the swing. As will be discussed in greater detail in connection with the embodiment of FIG. 4, a biasing mechanism 120' can also be used which fixedly biases the chains 114*a*, 114*b* outward from the horizontal support 104*b* of the horizontal ladder 102 without departing from the spirit of the present invention.

Referring now to FIGS. 3A-3C, a biasing mechanism 120 is illustrated. As shown, the biasing mechanism 120 has a first distance member 124 that has a first and second end 126*a*, 126*b*. The second end 126*b* has a chain capture member 130 that extends laterally outward from the distance member 124 and is connected to a ring 132 that defines an opening 134 at the outer end of the chain capture member 130. As is illustrated in FIGS. 1 and 2, the chains 114*a*, 114*b* of the swing extend through the ring 132 of the chain capture member 130 and are thus distanced from the distance member 124.

As is also illustrated in FIGS. 3A and 3B, the first end 126*a* of the distance member 124 is preferably a beveled end 136. Preferably, there is an opening 146 in the beveled end 136 of the distance member 124 that receives a first end of an engagement chain 142. The engagement chain 142 is secured within the beveled end 136 by a pin 144 that extends through the distance member 124, and the portion of the chain 142 that has been positioned in the opening 146 in the beveled end 136 of the distance member. A second end of the engagement chain 142 is coupled to a bias member 152 via a spring 150 within a coupling member 154. The coupling member 154 includes an opening 155 that is sized so as to receive the beveled end 126*a* of the distance member 124. The biasing member 152 urges the beveled end 136 of the distance member 124 into the opening.

As is also illustrated in FIGS. 3A-3C, the coupling member 154 is rotatably mounted on a shaft 156 that is positioned between a first and second mating housing 170*a*, 170*b*. A biasing spring 160 is positioned about the shaft 156 and engages with a bias member 152 so as to urge the bias member 152 to rotate about the shaft 156. The bias member 152 includes a horizontal arm 172 that is sized so as to be positioned within longitudinal shafts 176 of the coupling member 154. An end 180 of the spring 160 engages with a spring capture arm 177 of the bias member 152 so as to urge the bias member 152 to rotate about the shaft thereby urging the coupling member 154 also to rotate into a horizontal orientation in the manner shown in FIG. 1.

When a person wishes to swing, the person sits on the seat of the swing 112, which will draw the distance member 124 into a vertical orientation and thereby allow the beveled end 136 of the distance member 124 to be withdrawn from the coupling member 154 so that the coupling member does not bind as the person swings. Advantageously, by biasing the distance member 124 in a horizontal position, the swing 112 can automatically be removed from proximity to the horizontal climbing ladder 102 thereby decreasing the risk of a person falling off of the horizontal climbing ladder 102 and becoming entangled in the swing 112.

As discussed above, the biasing apparatus moves the swing or other hanging play device away from the area or volume underneath the horizontal climbing apparatus. In one particular implementation, a horizontal support 104*a* can be used to define a plane 105 (FIG. 2) that extends downward from the horizontal support 104*a*. This plane is located immediately adjacent the volume of space though which a person will fall should the person fall off the climbing ladder 102. By laterally moving the swing outward from the plane 105, the likelihood that the person will become entangled in the swing 112 when they fall is reduced as the swing is no longer immediately adjacent the volume of space through which the individual is falling.

The embodiment of the biasing mechanism 120 shown in FIGS. 3A-3C is spring biased so that the swing is held laterally away from the horizontal ladder 102. When the person wishes to swing on the swing 112, the spring biasing is overcome and the swing extends vertically downward from the horizontal support member 104*b* in the manner shown in FIG. 2. While the biasing mechanism described above is a spring-based biasing mechanism, it will be appreciated that any of a number of different alternative mechanisms can be used without departing from the spirit of the present invention. Such alternatives could include pneumatic or hydraulic cylinders incorporating compressed gas, e.g., nitrogen, or fluids.

It will be further appreciated, however, that in some implementations it may be desirable to not have a spring biasing system, but simply have a mechanism which more fixedly maintains the swing such that the swing is spaced away from the horizontal ladder 102 both when a person is swinging on the swing and when a person is using the horizontal ladder.

Figure 4:
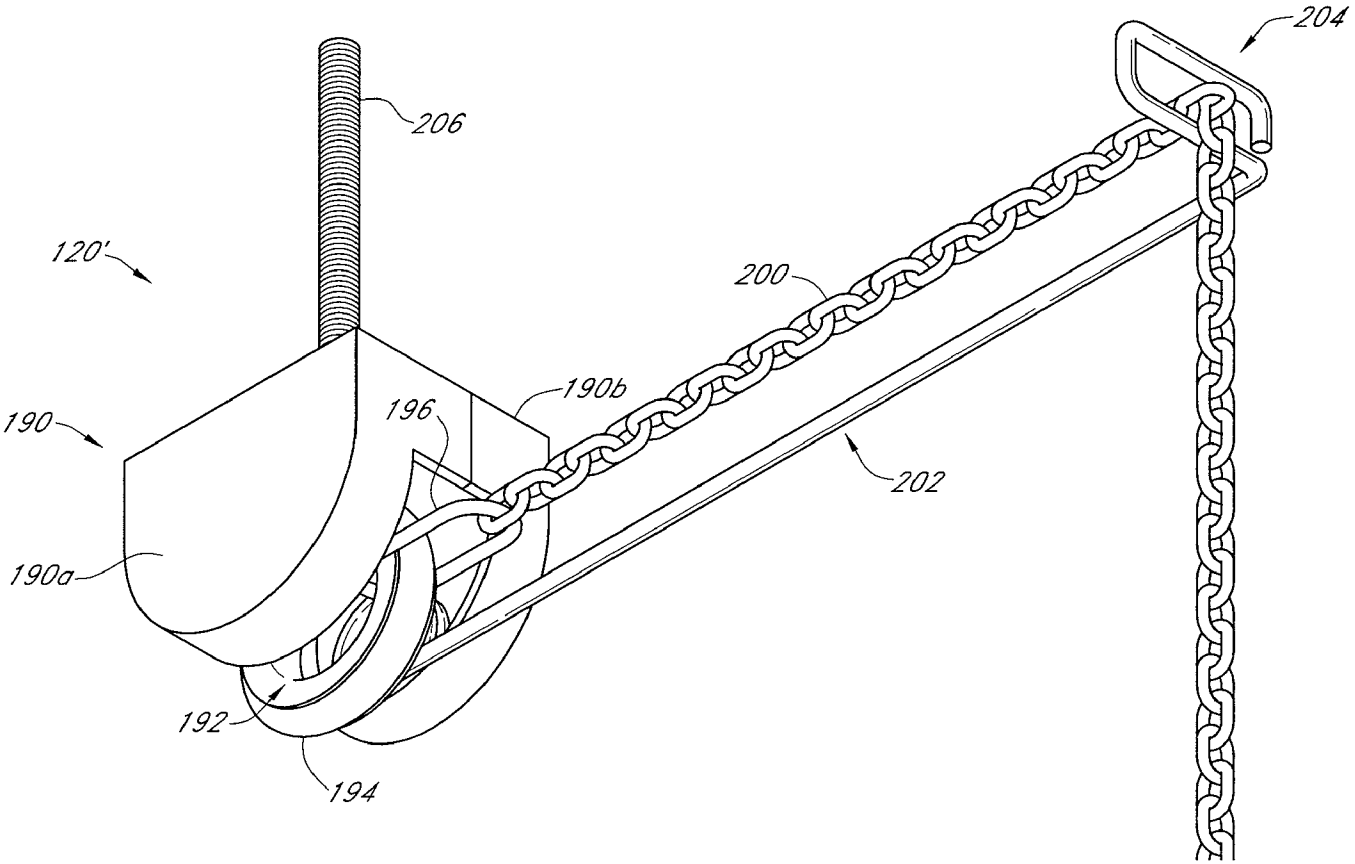
FIG. 4 is a second biasing mechanism that can be used in conjunction with the swing set assembly of FIGS. 1 and 2.

FIG. 4 is one exemplary embodiment of a biasing mechanism 120' that maintains the swing in a position that is laterally spaced from the horizontal ladder 102. As is shown in FIG. 4, the biasing mechanism 120' includes a housing 190 that is comprised of two members 190*a*, 190*b* that are mated together. The housing 190 defines an opening 192 into which a ring 194 can be fixedly positioned. The ring 194 is preferably sized so as to receive a mounting link 196 of a chain 200 that is attached to the swing.

As is also shown in FIG. 4, a fixed distance member 202 is also attached to the housing 190 so as to extend horizontally outward. The fixed distance member 202 defines a chain capture opening 204 through which the chain 200 is fed. Preferably, the fixed distance member 202 is fixably attached to the housing 190 so as to extend horizontally outward therefrom. The chain 200 is thus captured in the capture area 204 such that when the child swings on the swing the swing pivots about the capture area 204. The housing is preferably mounted to the horizontal support 104*b* via a mounting bolt 206 in a known manner. By using two of the assemblies 120' in the place of the assemblies 120 shown in FIGS. 1 and 2 the swing can be mounted to the horizontal support 104 in such a way that the swing is always maintained at a lateral distance from the horizontal climbing ladder 102 regardless of whether a person is swinging on the swing or not.

It will be appreciated that any of a number of different mechanisms for spacing the swing away from the vertical plane of the horizontal climbing member can be achieved without departing from the spirit of the present invention. By maintaining such spacing between the swing and the horizontal climbing ladder, the likelihood that children will become entangled in the swing when they fall off the horizontal climbing ladder is reduced.

Although the foregoing description has shown, described, and pointed out the fundamental features of the invention, it will be understood that various omissions, substitutions and changes in the form of the detail of the apparatus as illustrated as well as the uses thereof, may be made by those skilled in the art without departing from the spirit of the present invention. Consequently, the scope of the present invention shall not be limited by the foregoing discussion, but should be defined by the appended claims.

What is claimed is:

1. A swing set apparatus comprising:

a generally horizontal climbing ladder having a first and second support members with a plurality of struts extending therebetween;

a plurality of vertical support members that attach to the generally horizontal climbing ladder so as to maintain the generally horizontal climbing ladder at a first height above the ground wherein the generally horizontal climbing ladder defines a vertical plane extending between at least one edge of the horizontal climbing ladder and the ground;

at least one hanging play device attached to the generally horizontal climbing ladder; and a biasing member that spaces the hanging play device laterally away from the plane of the generally horizontal climbing ladder when the hanging play device is not in use so as to reduce the likelihood that a person falling from the generally horizontal climbing ladder will become entangled in the hanging play device.

2. The apparatus of claim 1, wherein the biasing member comprises a first and a second biasing members that engage with the hanging play device so as to maintain the hanging play device in the laterally spaced orientation.

3. The apparatus of claim 1, wherein the biasing member comprises a spring biased biasing member that biases the hanging play device laterally away from the generally horizontal climbing ladder when the hanging play device is not in use.

4. The apparatus of claim 3, wherein the biasing member allows the hanging play device to extend vertically downward from the generally horizontal climbing ladder when a person is sitting on the hanging play device.

5. The apparatus of claim 1, wherein the biasing member is a fixed member that extends laterally outward from the generally horizontal climbing ladder and wherein the biasing member captures the hanging play device and maintains the hanging play device so as to be laterally spaced away from the generally horizontal climbing ladder when the hanging play device is being used or is not in use.

6. The apparatus of claim 1, wherein the hanging play device comprises a swing.

7. An assembly for mounting a hanging play device to an elevated horizontal climbing structure, the assembly comprising the elevated horizontal climbing structure in combination with a biasing member that couples between the hanging play device and the elevated horizontal climbing ladder so that the hanging play device is laterally spaced away from the horizontal climbing structure when the hanging play device is not in use so as to reduce the likelihood that a person falling off the horizontal climbing structure would become entangled in the hanging play device.

8. The assembly of claim 7, wherein the hanging play device has flexible members and the biasing member comprises a first and a second biasing members that engage with the flexible members of the hanging play device so as to maintain the hanging play device in the laterally spaced orientation.

9. The assembly of claim 7, wherein the biasing member comprises a spring biased biasing member that biases the laterally away from the horizontal climbing ladder when the hanging play device is not in use.

10. The assembly of claim 9, wherein the biasing member allows the hanging play device to extend vertically downward from the horizontal climbing structure when a person is sitting on the hanging play device.

11. The assembly of claim 7, wherein the biasing member is a fixed member that extends laterally outward from the horizontal climbing structure and wherein the biasing member captures the hanging play device and maintains the hanging play device so as to be laterally spaced away from the horizontal climbing structure when the hanging play device is being used or is not in use.

12. The assembly of claim 7, wherein the horizontal climbing structure comprises a ladder.

13. The assembly of claim 7, wherein the hanging play device comprises a swing.

* * * * *